US006415933B1

(12) United States Patent
Kao

(10) Patent No.: US 6,415,933 B1
(45) Date of Patent: Jul. 9, 2002

(54) SOCKET SUSPENSION RACK

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 09/434,783

(22) Filed: Nov. 5, 1999

(51) Int. Cl.[7] ..... A47F 7/00; B65D 85/28
(52) U.S. Cl. ..... 211/70.6; 206/378
(58) Field of Search ..... 211/70.6; 206/378, 206/806, 493; 294/146

(56) References Cited

U.S. PATENT DOCUMENTS 4,344,244 A * 8/1982 Tyke ..... 40/611
4,597,496 A * 7/1986 Kaplan ..... 211/70.6
4,682,698 A * 7/1987 Handler et al. ..... 211/70.6
4,802,580 A * 2/1989 Andersen ..... 206/378
4,858,302 A * 8/1989 Stribiak ..... 29/568
5,228,570 A * 7/1993 Robinson ..... 206/378
5,862,913 A * 1/1999 Chou ..... 206/378
5,967,340 A * 10/1999 Kao ..... 211/70.6
6,092,655 A * 7/2000 Ernst ..... 206/378
6,095,329 A * 8/2000 Kao ..... 206/378

* cited by examiner

*Primary Examiner*—Daniel P. Stodola
*Assistant Examiner*—Khoa Tran
(74) *Attorney, Agent, or Firm*—Kolisch Hartwell Dickinson McCormack & Heuser

(57) ABSTRACT

A socket suspension rack includes a handle and a suspension rod extending from the handle. The suspension rod includes the top aligning with the top of the handle and a T-shaped flange formed on extending down from the bottom. A stopper is attached to the free end of the suspension rod. A number of socket connectors each including a T-shaped groove defined in the upper portion to receive the T-shaped flange of the suspension rod and having a socket stud extending down from a lower portion connect with a socket.

1 Claim, 8 Drawing Sheets

SOCKET SUSPENSION RACK

BACKGROUND OF THE INVENTION

1. Field of the Invention

The present invention relates to a socket suspension rack, and more particularly to a socket suspension rack that has a receiving space to prevent the sockets from bumping and a T-shaped flange to connect the socket connector more securely.

2. Description of Related Art

A first conventional socket suspension connector (50) in accordance with the prior art as shown in FIG. 6 comprises a square socket stud (52) containing a cavity (53) and a holder (51) formed on the top of the socket stud (52). A ball (55) partially exposed outward from the socket stud (52) and a spring (54) pressing on the ball (55) to make the ball (55) extend outward are received in the cavity (53). A socket (not shown) can be mounted on the socket stud (52) with the ball (55) detachably received in the depression (not shown) inside the socket. The holder (51) is secured on an elongated track (not shown), thereby attaching the socket suspension connector (50) together with the socket to the elongated track. However, the spring (54) and the ball (55) must be pressed into the cavity (53) after the socket stud (52) is formed by injection molding such that the assembly process of the socket suspension (50) is complicated, thereby increasing the cost of making it.

A second conventional socket suspension rack (60) in accordance with the prior art as shown in FIG. 7 comprises a plate (60) including a upper portion containing two hole (601) to hang the plate (60) on pegs or hooks and a lower portion forming a dovetail flange (602) which contains a locking hole (603) near each end. A locking pin (61) is inserted into each locking hole (603) to prevent the socket connector (70) from detaching from the plate (60).

Each socket connector (70) has a dovetail groove (71) formed on one end to receive the dovetail flange (602) of the plate (60) and a rectangular portion (72) with four sidewalls formed on the other end. At least one of the four walls has a boss (73), and the wall having the boss (73) contains two slits (721) so that the wall having the boss (73) is flexible relative to the other walls. A socket (30) includes an engaging hole (31) to receive the rectangular portion (72) of the socket connector (70). The engaging hole (31) has an indentation (32) defined in the inner periphery. The boss (73) is configured to be received in the indentation (32) when the rectangular portion (72) is inserted into the engaging hole (31).

The dovetail flange (602) has two inclined sides. Referring to FIG. 9, the socket connector (70) can be detached from the plate (60) along the two inclined sides of the dovetail flange (602) when a side force is applied to the socket (30) or the socket connector (70).

The present invention has arisen to mitigate and/or obviate the disadvantage of these two conventional socket suspension racks.

SUMMARY OF THE INVENTION

The socket suspension rack in accordance with the present invention comprises a handle and suspension rod combination with an end stopper and a number of socket connectors detachably mounted on the suspension rod.

Further benefits and advantages of the present invention will become apparent after a careful reading of the detailed description with appropriate reference to the accompanying drawings.

DETAILED DESCRIPTION OF THE INVENTION

Figure 1:
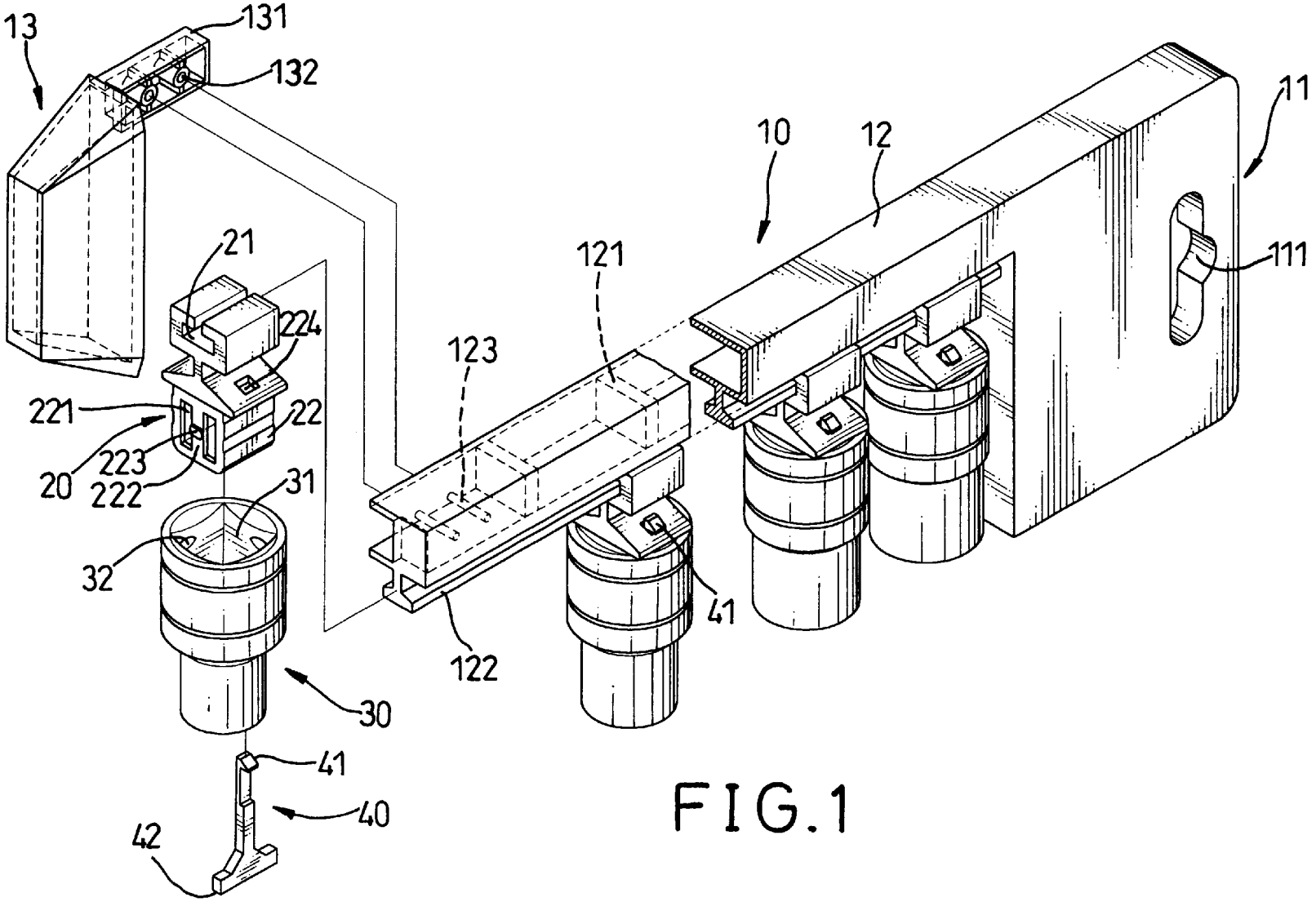
FIG. 1 is a partially exploded perspective view of a socket suspension rack in accordance with the present invention.
Figure 2:
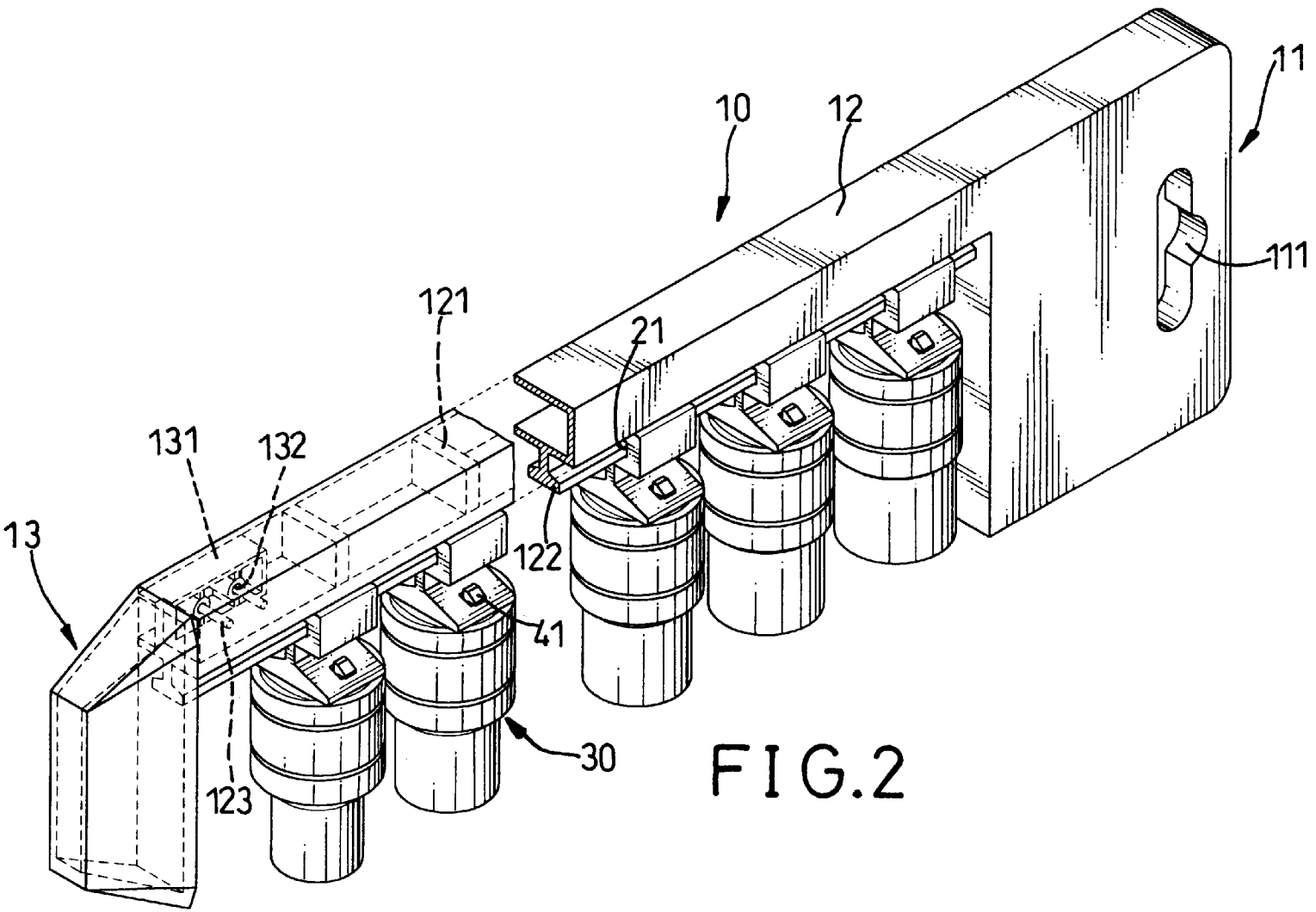
FIG. 2 is a perspective view of the socket suspension rack in FIG. 1.
Figure 3:
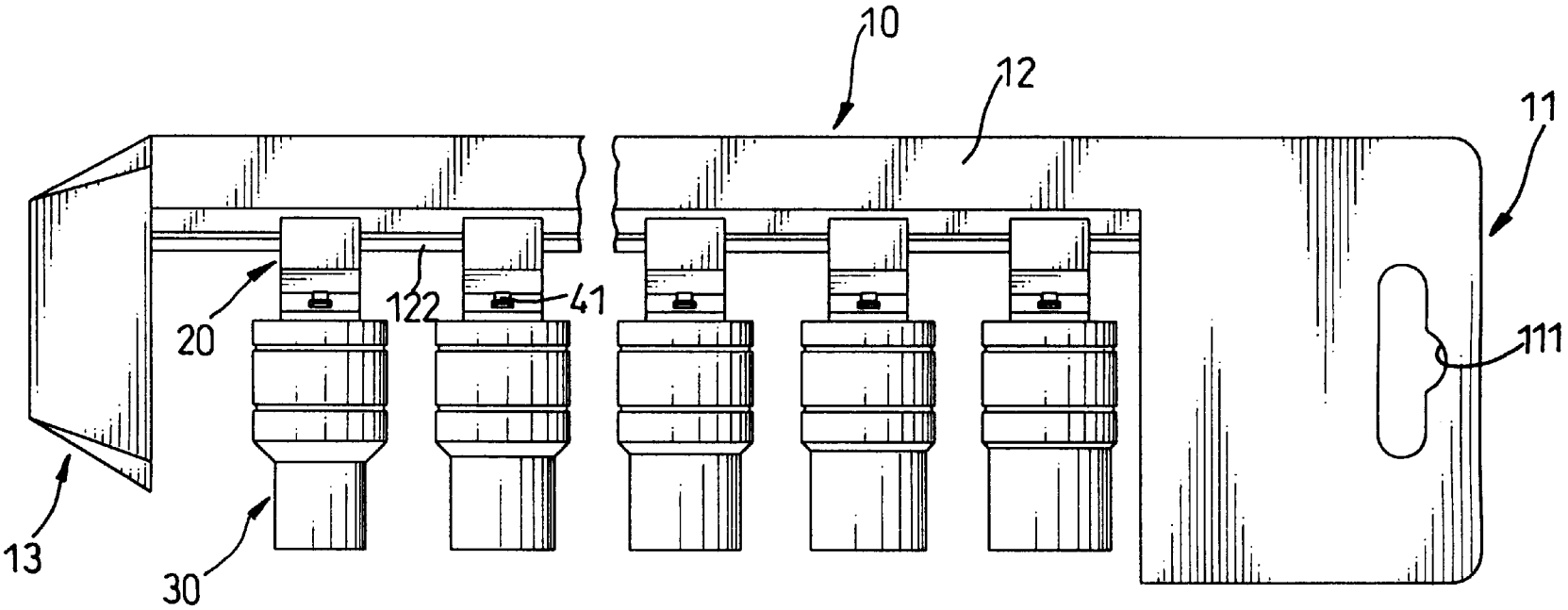
FIG. 3 is a side plan view of the socket suspension rack in FIG. 1.

Referring to the drawings and initially to FIG. 1 and FIG. 2, a socket suspension rack (10) in accordance with the present invention comprises a handle (11) with a hole (111), a suspension rod (12) integrally formed with the handle (11), a number of socket connectors (20) slidably attached to the suspension rod (12) and an end stopper (13).

The suspension rod (12) is II-shaped multiple ribs (121) formed on the inside of the suspension rod (12) along its length with the top aligning with the top of the handle (11) and a T-shaped flange (122) extending from the bottom. The suspension rod (12) also has at least one pin (123) formed near the free end.

A stopper (13) with a hollow connecting bar (131) extending toward the suspension rod (12) is attached to the free end of the suspension rod (12) to prevent the socket connectors (20) from sliding off the suspension rod (12). The connecting bar (131) is received in the suspension rod (12) and has at least one hollow stud (132) corresponding to and connected to each pin (123).

The socket suspension rack (10) further contains a receiving space that is formed by the handle (11), suspension rod (12) and the stopper (13). The space can receive sockets and prevent the sockets from bumping.

The socket connector (20) has a T-shaped groove (21) defined in the upper end to received the T-shaped flange (122) of the suspension rod (12) and a socket stud (22) extending down from the lower end with an aperture (224) defined in the top of the socket stud (22). The socket stud (22) includes a passage (221) having a flexible strip (222) in one end. The flexible strip (222) has a boss (223) extending outward.

Each socket (30) contains a cubic recess (31) to receive the socket stud (22) of the socket connector (20) therein. The cubic recess (31) of the socket (30) has four side walls each forming an indentatio (32) to receive the boss (223) of the flexible strip (222) therein.

A socket lock (40) has a hook (41) formed on the top and a stop bar (42) extending transversely at the lower end so that the hook (40) penetrates the socket (30) and the socket stud (22) and is securely received in the aperture (224). The length of the stop bar (42) is longer than the inner diameter of a stop hole (not shown) in the socket to prevent the socket (30) from being pulled from the socket connector (20).

Figure 4:
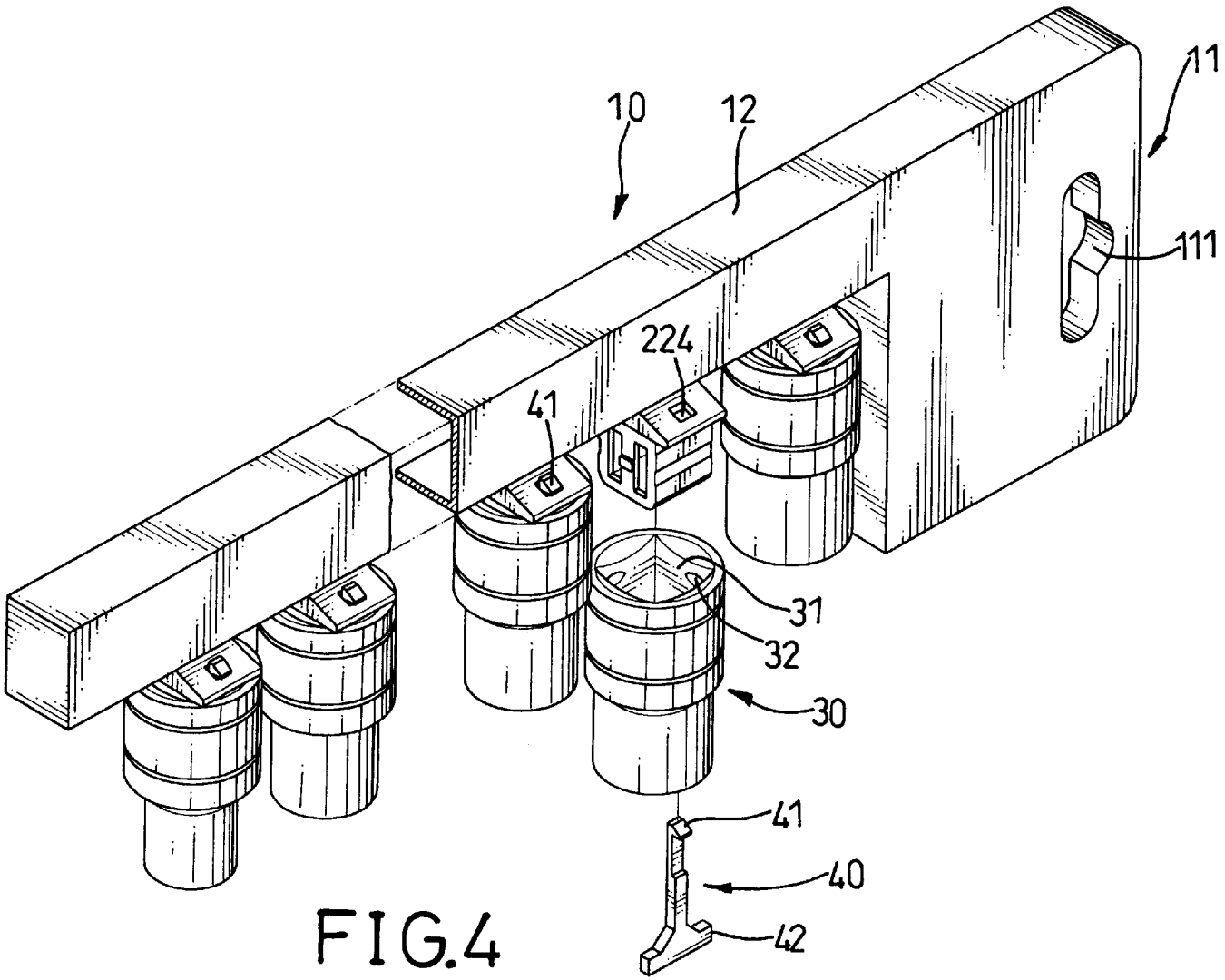
FIG. 4 is a partially exploded perspective view of another embodiment of the socket suspension rack in FIG. 1.
Figure 5:
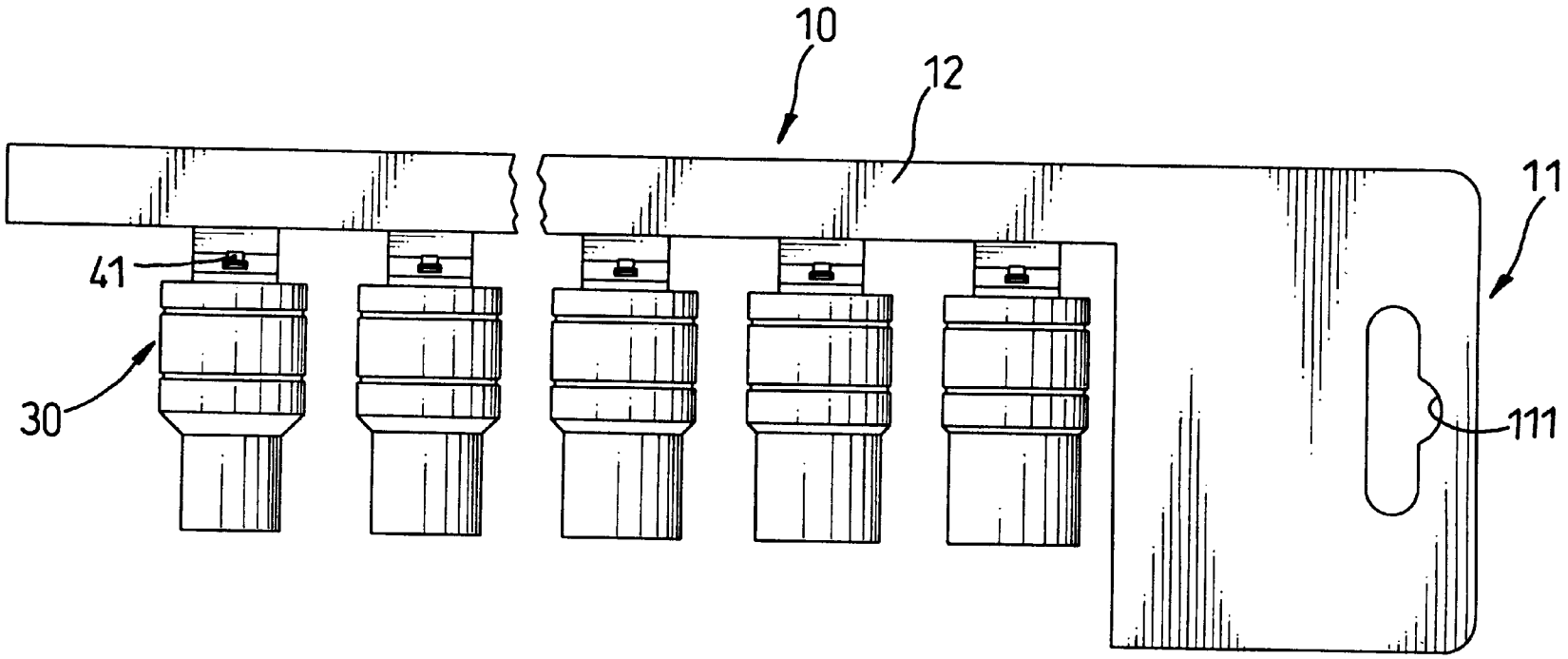
FIG. 5 is a side plan view of the socket suspension rack in FIG. 4.
Figure 6:
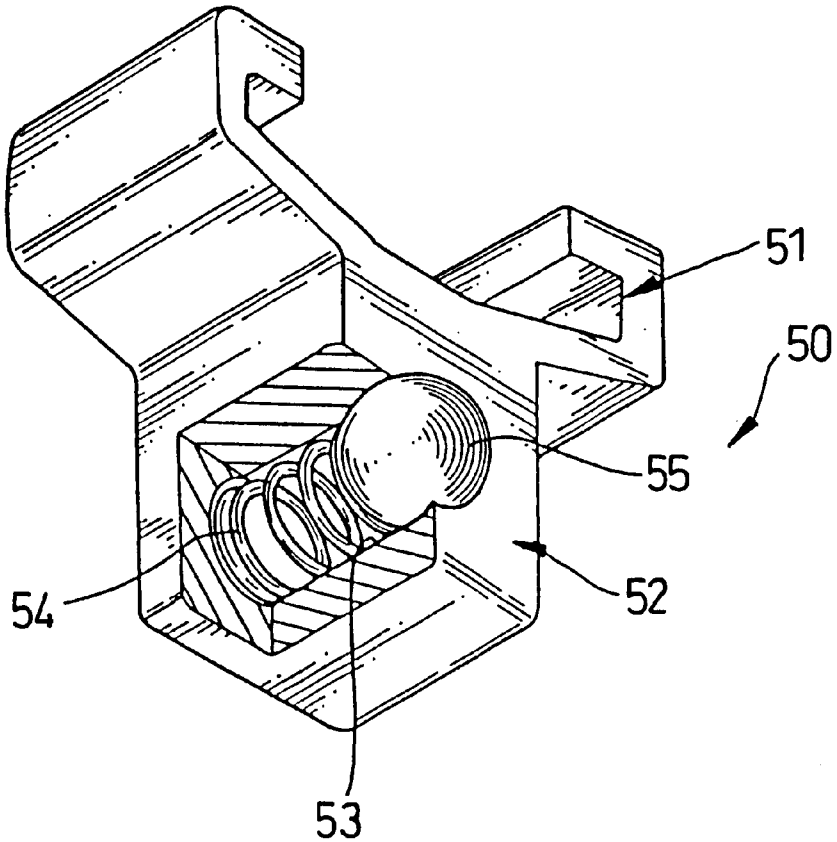
FIG.6 PRIOR ART
FIG. 6 is a perspective view of a first conventional socket connector in accordance with the prior art.
Figure 7:
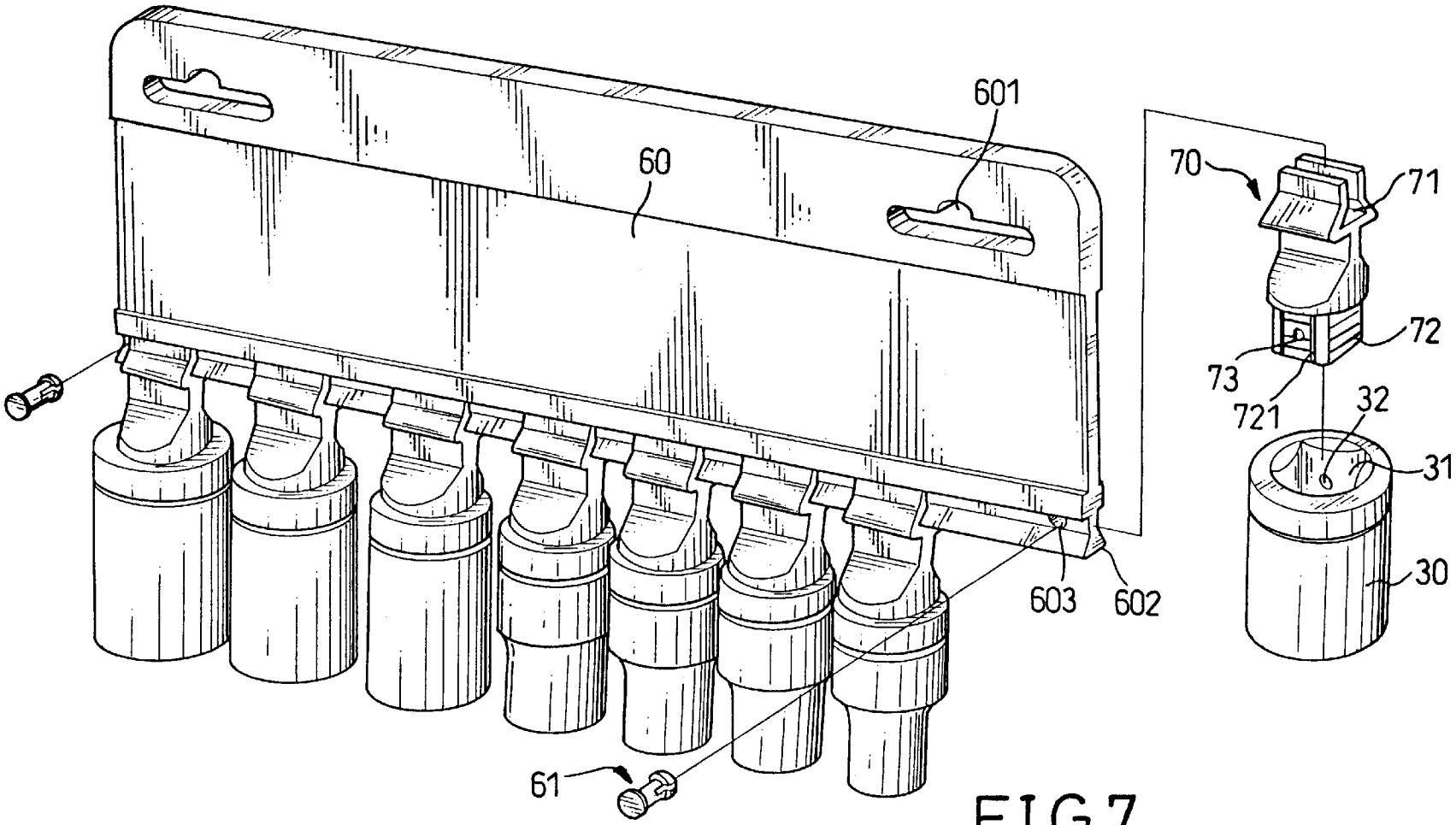
FIG.7 PRIOR ART
FIG. 7 is a partially exploded perspective view of a second conventional socket suspension rack in accordance with the prior art.
Figure 8:
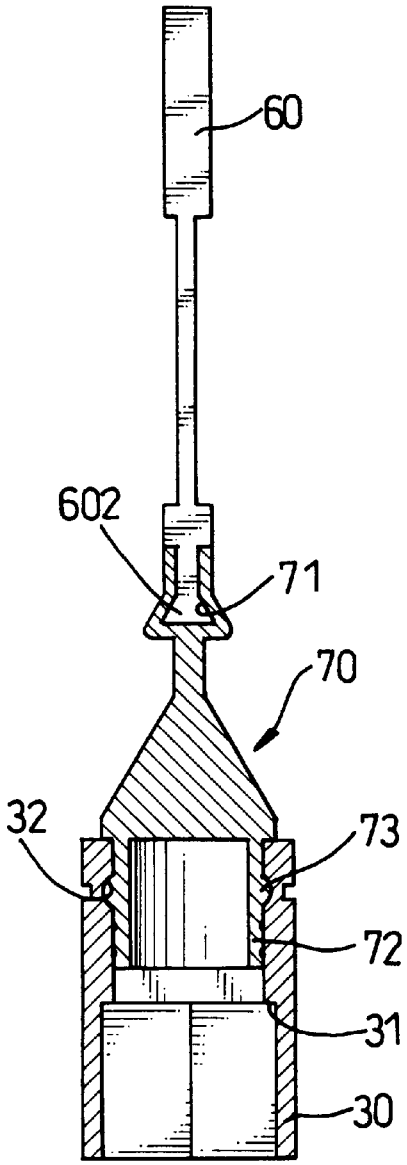
FIG.8 PRIOR ART
FIG. 8 is an end plan view in partial section of the socket rack in FIG. 7.
Figure 9:
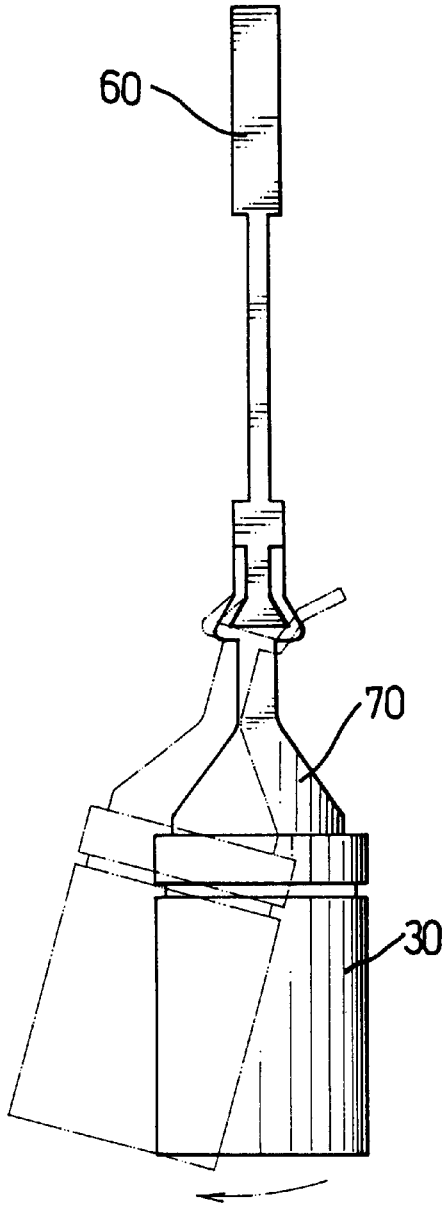
FIG.9 PRIOR ART
FIG. 9 is an end plan view of the socket rack and the socket in FIG. 7 with a side force applied to detach the socket suspension connector.

Referring to FIG. 4 and FIG. 5, it's another embodiment of the socket suspension rack of the present invention. A socket suspension rack (10) comprises a handle (11) with a hole (111) and a suspension rod (12) extending from the handle (11) to from a space. The space can receive sockets and prevent the sockets from bumping. The suspension rod (12) includes a first side aligning with one side of the handle (11) and a second side having multiple socket studs (22) extending down therefrom to connect with a socket. The space can receive sockets and prevent the sockets from bumping.

All the parts of the suspension rack (10) are injection molded. The insertion of a spring and a ball into the cavity is unnecessary for the present invention. Further the socket suspension rack can be made of various colors for either the decorative effect or color-coding. The handle (11), the suspension rod (12) and the stopper (13) form an open and somewhat protected space to receive the socket (30) and prevent the sockets from bumping. The T-shaped flange (122) and groove (21) make the socket connector (20) and the suspension rod (12) connect more rigidly.

Although the invention has been explained in relation to its preferred embodiment, it is to be understood that many other possible modifications and variations can be made without departing from the spirit and scope of the invention as hereinafter claimed.

What is claimed is:

1. A socket suspension rack comprising:

a handle with a hole;

a suspension rod extending from said handle to form an L-shaped configuration with the handle and having a free end, said suspension rod including a first side flush with one side of said handle and a second side forming a T-shaped flange on said suspension rod and opposing said first side of said suspension rod;

at least one pin near a limitation of said free end of said suspension rod;

at least one socket connector, each including an upper portion forming a T-shaped groove to receive said T-shaped flange and a lower portion having a socket stud extending down therefrom to connect with a socket, said socket stud defining a passage therein and having a flexible strip formed in one end, said flexible strip having a boss formed thereon;

a stopper attached to said free end of said suspension rod and parallel to said handle to prevent said at least one socket connector from sliding off said suspension rod, said stopper having a connecting bar extending from said stopper toward said suspension rod, said connecting bar received in said suspension rod and defining at least one hollow stud each corresponding to and detachably connected to each said pin; and a receiving space formed by said handle, said suspension rod and said stopper, said receiving space adapted to receive said at least one socket connector and socket completely therein.

* * * * *